US010330321B2

(12) United States Patent
Snyder

(10) Patent No.: US 10,330,321 B2
(45) Date of Patent: Jun. 25, 2019

(54) CIRCUMFERENTIALLY AND AXIALLY STAGED CAN COMBUSTOR FOR GAS TURBINE ENGINE

(71) Applicant: United Technologies Corporation, Farmington, CT (US)

(72) Inventor: Timothy S. Snyder, Glastonbury, CT (US)

(73) Assignee: United Technologies Corporation, Farmington, CT (US)

( * ) Notice: Subject to any disclaimer, the term of this patent is extended or adjusted under 35 U.S.C. 154(b) by 400 days.

(21) Appl. No.: 15/025,827

(22) PCT Filed: Oct. 20, 2014

(86) PCT No.: PCT/US2014/061366
§ 371 (c)(1),
(2) Date: Mar. 29, 2016

(87) PCT Pub. No.: WO2015/061217
PCT Pub. Date: Apr. 30, 2015

(65) Prior Publication Data

US 2016/0298852 A1 Oct. 13, 2016

Related U.S. Application Data

(60) Provisional application No. 61/895,169, filed on Oct. 24, 2013.

(51) Int. Cl.

| | |
|---|---|
| ***F23R 3/12*** | (2006.01) |
| ***F23R 3/34*** | (2006.01) |
| ***F23R 3/46*** | (2006.01) |

(52) U.S. Cl.
CPC ..... *F23R 3/346* (2013.01); *F23R 3/12* (2013.01); *F23R 3/343* (2013.01); *F23R 3/46* (2013.01)

(58) Field of Classification Search
CPC .. F23R 3/286; F23R 3/34; F23R 3/343; F23R 3/346; F02C 7/222; F02C 7/228; F05D 2270/31
See application file for complete search history.

(56) References Cited

U.S. PATENT DOCUMENTS 3,872,664 A * 3/1975 Lohmann ..... F23R 3/14 431/9
4,891,936 A 1/1990 Shekleton et al.
5,003,771 A * 4/1991 Kester ..... F02C 7/228 60/243

(Continued)

FOREIGN PATENT DOCUMENTS

JP 08068537 3/1996

OTHER PUBLICATIONS

EP search report for EP14855899.2 dated Sep. 22, 2016.

*Primary Examiner* — Carlos A Rivera
(74) *Attorney, Agent, or Firm* — O'Shea Getz P.C.

(57) ABSTRACT

A combustor section for a gas turbine engine includes a can combustor with a combustion chamber. A pilot fuel injection system is in axial communication with the combustion chamber. A main fuel injection system is in radial communication with the combustion chamber. The main fuel injection system includes a multiple of first main fuel nozzles that circumferentially alternate with a multiple of second main fuel nozzles.

8 Claims, 6 Drawing Sheets

(56) References Cited

U.S. PATENT DOCUMENTS 5,257,502 A * 11/1993 Napoli ..... F02C 7/228 60/739
5,289,685 A * 3/1994 Hoffa ..... F02C 7/222 60/739
5,402,634 A * 4/1995 Marshall ..... F02C 7/232 60/734
5,884,483 A * 3/1999 Munro ..... F02C 7/22 60/734
6,289,667 B1 9/2001 Kolaczkowski et al.
7,665,305 B2 2/2010 Cornwell et al.
7,738,694 B2 6/2010 Prociw et al.
7,870,736 B2 1/2011 Homitz et al.
7,896,620 B1 3/2011 Ewing, Jr.
7,966,821 B2 * 6/2011 Zupanc ..... F23R 3/343 60/748
8,057,224 B2 11/2011 Knoepfel
8,079,218 B2 12/2011 Widener
8,113,001 B2 2/2012 Singh et al.
8,117,846 B2 2/2012 Wilbraham
8,162,287 B2 4/2012 Overman et al.
8,192,688 B2 6/2012 Hagen et al.
8,240,150 B2 8/2012 Varatharajan et al.
8,262,344 B2 9/2012 Alexander et al.
8,316,644 B2 11/2012 Wilbraham
8,387,390 B2 3/2013 Haynes
8,495,982 B2 7/2013 Laster et al.
8,789,374 B2 * 7/2014 Hoke ..... F23R 3/06 60/746
2008/0264033 A1 10/2008 Lacy et al.
2009/0084082 A1 * 4/2009 Martin ..... F01D 9/023 60/39.281
2010/0071377 A1 3/2010 Fox et al.
2010/0223930 A1 9/2010 Chila
2010/0242483 A1 * 9/2010 Snyder ..... F23R 3/06 60/748
2011/0296839 A1 12/2011 Van Nieuwenhuizen et al.
2012/0186262 A1 7/2012 Hoke
2013/0019604 A1 * 1/2013 Cunha ..... F23N 5/16 60/772
2013/0031906 A1 2/2013 Dicintio et al.
2013/0340436 A1 * 12/2013 Abreu ..... F02C 7/222 60/737
2016/0245525 A1 * 8/2016 Snyder, III ..... F23R 3/06

* cited by examiner

| POWER CONDITION | PILOT FUEL | M1 FUEL | M2 FUEL |
|---|---|---|---|
| LOW | 100% | OFF | OFF |
| PARTIAL | 20–40% | 80–60% | OFF |
| HIGH | ≈ 20% | 30–40% | 30–40% |

*FIG. 6*

CIRCUMFERENTIALLY AND AXIALLY STAGED CAN COMBUSTOR FOR GAS TURBINE ENGINE

CROSS-REFERENCE TO RELATED APPLICATION

This application claims priority to PCT Patent Application No. PCT/US14/61366 filed Oct. 20, 2014, which claims priority to U.S. Provisional Application Ser. No. 61/895,169 filed Oct. 24, 2013, which are hereby incorporated herein by reference in their entireties.

BACKGROUND

The present disclosure relates to a gas turbine engine and, more particularly, to a combustor section therefor.

Gas turbine engines generally include a compressor section to pressurize an airflow, a combustor section to burn a hydrocarbon fuel in the presence of the pressurized air, and a turbine section to extract energy from the resultant combustion gases. Combustion of the hydrocarbon fuel in the presence of pressurized air may produce nitrogen oxide ($NO_X$) emissions that are subjected to excessively stringent controls by regulatory authorities, and thus may be sought to be minimized.

Dry Low NOx (DLN) combustor sections utilize a fuel-to-air lean premix strategy which operates near flame stability envelope limits where noise, flame blow-off (BO), and flashback may affect engine performance such that the DLN strategy may be limited to land-based industrial gas turbine architectures. In some DLN strategies, significant piloting is utilized to control combustion dynamics. Such strategies, although effective, may produce nitrogen oxide ($NO_X$) emissions that are subjected to excessively stringent controls by regulatory authorities and thus may be sought to be minimized.

SUMMARY

A combustor section for a gas turbine engine, according to one disclosed non-limiting embodiment of the present disclosure, includes a can combustor, a pilot fuel injection system and a main fuel injection system. The can combustor includes a combustion chamber. The pilot fuel injection system is in axial communication with the combustion chamber. The main fuel injection system is in radial communication with the combustion chamber. The main fuel injection system includes a multiple of first main fuel nozzles that circumferentially alternate with a multiple of second main fuel nozzles.

In a further embodiment of the present disclosure, the multiple of first main fuel nozzles and/or the multiple of second main fuel nozzles are fueled in pairs.

In a further embodiment of any of the foregoing embodiments of the present disclosure, the multiple of first main fuel nozzles are fueled through the multiple of second main fuel nozzles such that the multiple of first main fuel nozzles are each downstream to a respective one of the multiple of second main fuel nozzles.

In a further embodiment of any of the foregoing embodiments of the present disclosure, a valve is included in each of the multiple of second main fuel nozzles which selectively communicate fuel to a respective one of the multiple of first main fuel nozzles.

In a further embodiment of any of the foregoing embodiments of the present disclosure, the pilot fuel injection system includes a multiple of forward fuel injectors. One of the forward fuel injectors is within each of a multiple of can combustors.

A gas turbine engine, according to another disclosed non-limiting embodiment of the present disclosure, includes a compressor section, a turbine section, a combustor section, a pilot fuel injection system and a main fuel injection system. The combustion section is between the compressor section and the turbine section. The combustor section includes a multiple of can combustors each including a combustion chamber. The pilot fuel injection system is in axial communication with the combustion chamber of each of the can combustors. The a main fuel injection system is in radial communication with the combustion chamber of each of the can combustors. The main fuel injection system includes a multiple of first main fuel nozzles that alternate with a multiple of second main fuel nozzles around each of the can combustors.

In a further embodiment of any of the foregoing embodiments of the present disclosure, the multiple of can combustors communicate with a transition section in communication with the turbine section.

In a further embodiment of any of the foregoing embodiments of the present disclosure, the pilot fuel injection system includes a multiple of forward fuel injectors. One of the forward fuel injectors is within each of the multiple of can combustors.

In a further embodiment of any of the foregoing embodiments of the present disclosure, the multiple of first main fuel nozzles and/or the multiple of second main fuel nozzles are fueled in pairs.

In a further embodiment of any of the foregoing embodiments of the present disclosure, the multiple of first main fuel nozzles are fueled through the multiple of second main fuel nozzles such that the multiple of first main fuel nozzles are each downstream to a respective one of the multiple of second main fuel nozzles.

In a further embodiment of any of the foregoing embodiments of the present disclosure, a valve is included in each of the multiple of second main fuel nozzles which selectively communicate fuel to a respective one of the multiple of first main fuel nozzles.

A method of communicating fuel to a combustor section of a gas turbine engine, according to another disclosed non-limiting embodiment of the present disclosure, includes communicating pilot fuel axially into a combustion chamber; communicating fuel radially inboard into the combustion chamber; and circumferentially varying the fuel communicating radially inboard into the combustion chamber to control combustion dynamics.

In a further embodiment of any of the foregoing embodiments of the present disclosure, the method includes selectively communicating the fuel radially inboard into the combustion chamber through a multiple of first main fuel nozzles, and a multiple of second main fuel nozzles.

In a further embodiment of any of the foregoing embodiments of the present disclosure, the multiple of first main fuel nozzles are each downstream to a respective one of the multiple of second main fuel nozzles to circulate fuel through the multiple of second main fuel nozzles when the multiple of second main fuel nozzles are inactive.

In a further embodiment of any of the foregoing embodiments of the present disclosure, each quench zone overlaps with a respectively adjacent quench zone to define a shear region.

The foregoing features and elements may be combined in various combinations without exclusivity, unless expressly indicated otherwise. These features and elements as well as the operation thereof will become more apparent in light of the following description and the accompanying drawings. It should be understood, however, the following description and drawings are intended to be exemplary in nature and non-limiting.

BRIEF DESCRIPTION OF THE DRAWINGS

Various features will become apparent to those skilled in the art from the following detailed description of the disclosed non-limiting embodiments. The drawings that accompany the detailed description can be briefly described as follows:

FIG. 6 is a chart of example power conditions for the combustor section.

DETAILED DESCRIPTION

Figure 1:
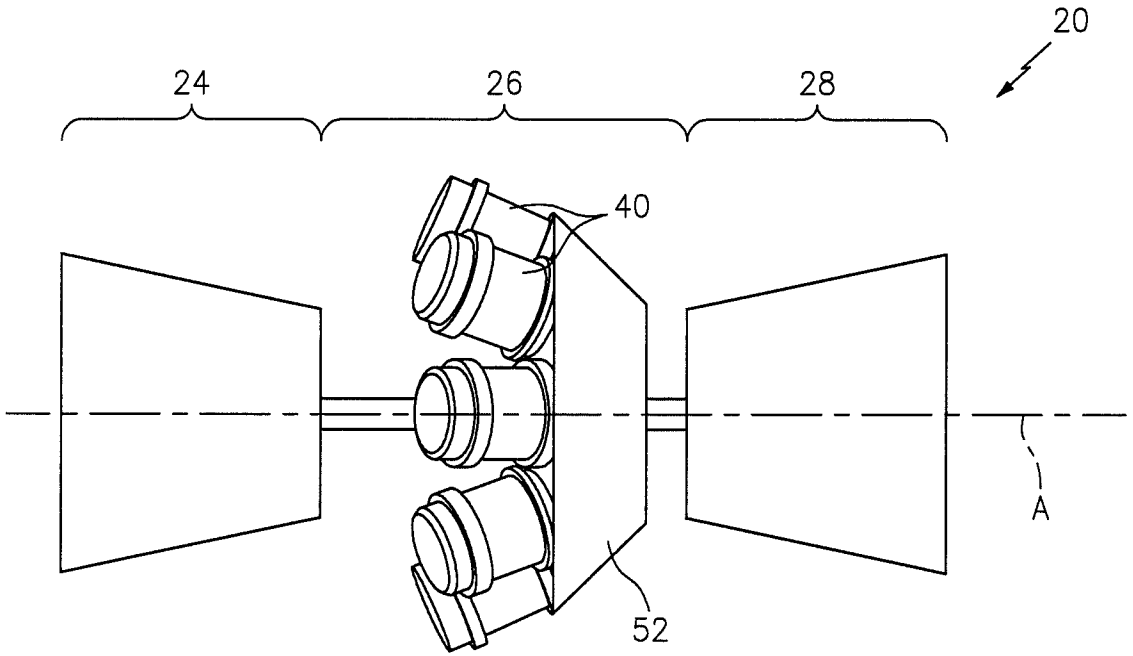
FIG. 1 is a schematic view of an example gas turbine engine architecture with a combustor section having a multiple of combustor cans.
Figure 2:
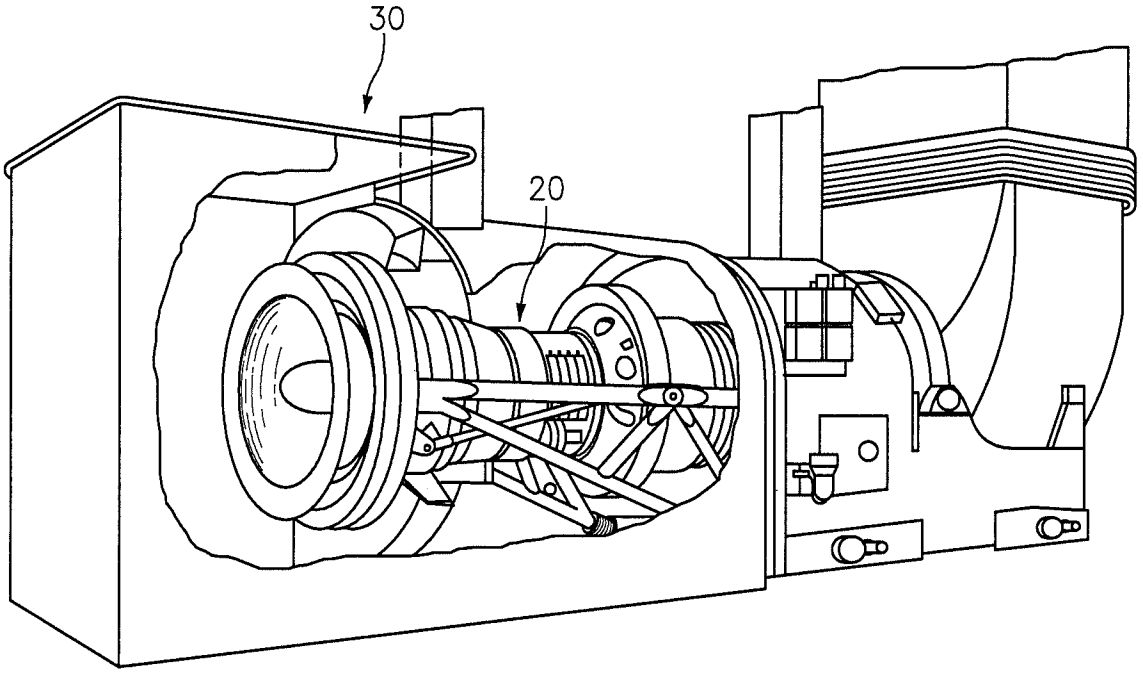
FIG. 2 is a schematic view of an example gas turbine engine in an industrial gas turbine environment.

FIG. 1 schematically illustrates a gas turbine engine 20. The gas turbine engine 20 generally includes a compressor section 24, a combustor section 26 and a turbine section 28. The engine 20 may be located within an enclosure 30 (see FIG. 2) typical of an industrial gas turbine (IGT). Although depicted as specific engine architecture in the disclosed non-limiting embodiments, it should be understood that the concepts described herein are not limited to only such an architecture as the teachings may be applied to other gas turbine architectures with a can combustor architecture.

Figure 3:
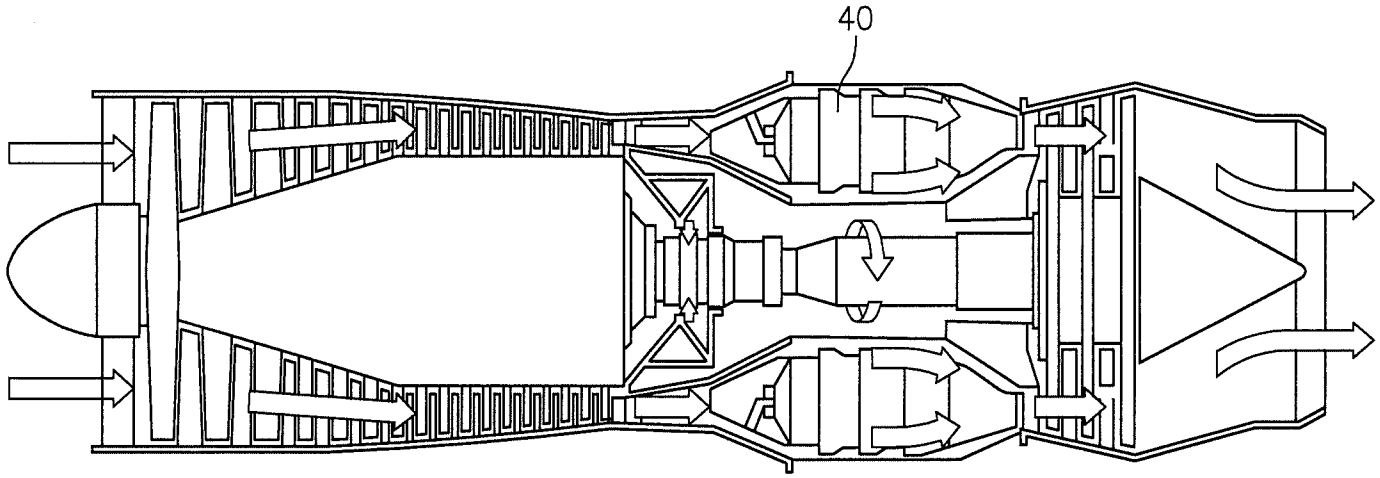
FIG. 3 is a schematic cross-section of another example gas turbine engine.

The combustor section 26 generally includes a multiple of can combustors 40 which circumferentially surround the engine central longitudinal axis A. It should be appreciated that various vertical or silo orientation arrangements may be provided for the multiple of can combustors 40 to include but not be limited to angled (shown) and axial arrangements (see FIG. 3).

Figure 4:
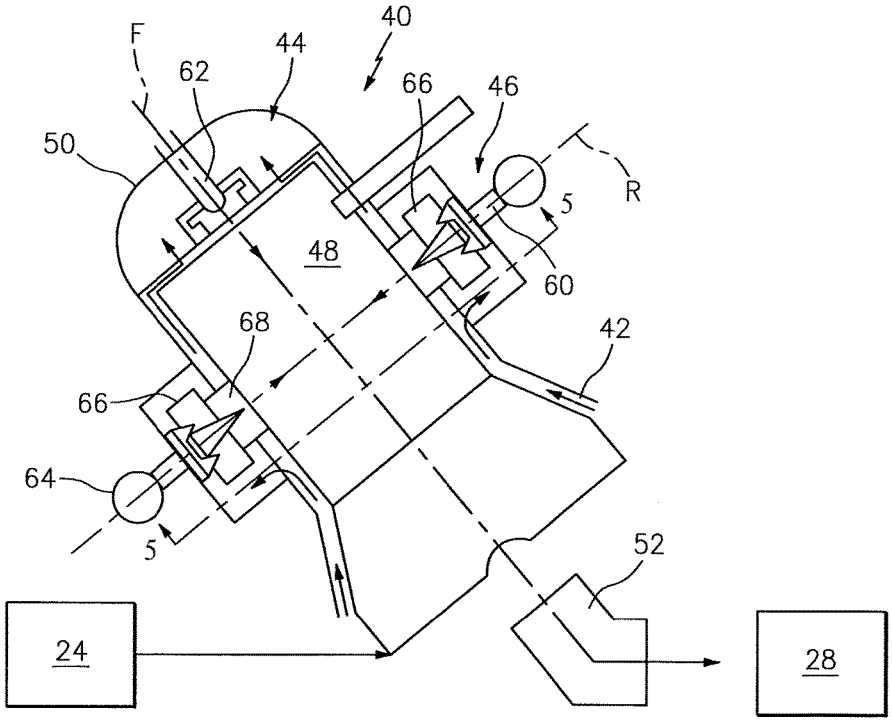
FIG. 4 is a lateral schematic sectional view of the combustor section of one of a multiple of can combustors.

With reference to FIG. 4, each of the multiple of can combustors 40 receives compressed air from the compressor section 24 through an annulus 42. The compressed airflow is communicated from the annulus 42, through a pilot fuel injection system 44 and a main fuel injection system 46 into a combustion chamber 48 of each of the multiple of can combustors 40. That is, the compressed airflow is directed through the annulus 42 around each combustion chamber 48 toward an end cap 50 of each can combustor 40. The airflow passes from the annulus 42 through a multiple of nozzle swirler arrangements of the fuel injection systems 44, 46 from the annulus 42 to the combustion chamber 48. The fuel and air injected by the pilot fuel injection system 44 and the main fuel injection system 46 is mixed and burned within the combustion chamber 48 of each of the multiple of can combustors 40, then collectively communicated through a transition section 52 (also shown in FIG. 1) for expansion through the turbine section 28. Each of the multiple of can combustors 40 locates the pilot fuel injection system 44 upstream of the main fuel injection system 46 with respect to the transition section 52.

The main fuel injection system 46 communicates with the combustion chamber 48 downstream of the pilot fuel injection system 44 and includes a multiple of main fuel nozzles 60 (illustrated schematically) located around each combustion chamber 48 to introduce a portion of the fuel required for desired combustion performance, e.g., emissions, operability, durability as well as to lean-out the fuel contribution provided by the pilot fuel injection system 44. Each of the multiple of main fuel nozzles 60 are located along an axis R generally transverse to an axis F defined by an axial fuel nozzle 62 located within the end cap 50 of each can combustor 40.

A radially outer fuel manifold 64 (illustrated schematically in FIG. 5) of the main fuel injection system 46 communicates fuel to each of the multiple of main fuel nozzles 60. Each of the multiple of main fuel nozzles 60 directs the fuel through a main swirler 66 located coaxially with a radial outer port 68 to communicate an air-fuel mixture into the combustion chamber 48.

Figure 5:
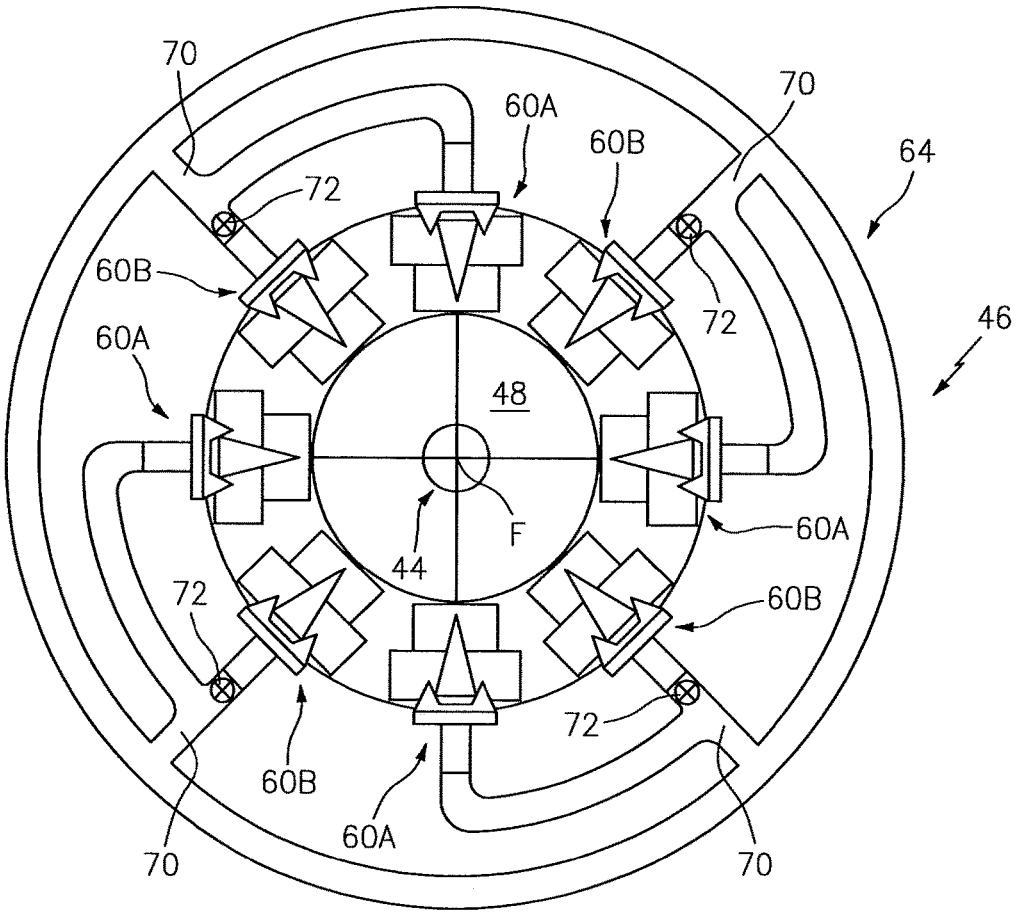
FIG. 5 is an schematic sectional view of one can combustor.

With reference to FIG. 5, the multiple of main fuel nozzles 60 and associated swirlers 66 (see FIG. 4) of the main fuel injection system 46 includes alternating first main fuel nozzles 60A that alternate with a multiple of second main fuel nozzles 60B around the combustion chamber 48. It should be appreciated that "alternate" as defined herein includes various patterns such as 60A, 60B, 60A . . . ; 60A, 60A, 60B, 60B, 60A . . . etc.

The first and second main fuel nozzles 60A, 60B in the disclosed non-limiting embodiment receive fuel from the radially outer fuel manifold 64 in pairs. In this disclosed non-limiting embodiment, a fuel stem 70 from the radially outer fuel manifold 64 communicates fuel to one of the first multiple of main fuel nozzles 60A first through an adjacent one of the multiple of second main fuel nozzles 60B. That is, each of the multiple of main fuel nozzle 60A are downstream to an associated one of the multiple of second main fuel nozzles 60B with respect to fuel flow.

A valve 72 (illustrated schematically) is associated with each of the multiple of second main fuel nozzles 60B such that under an example low power condition and partial power condition, the valve 72 is closed to direct fuel to the one of the first multiple of main fuel nozzle 60A yet circulates fuel with respect to the multiple of second main fuel nozzles 60B to avoid fuel coking therein. That is, each fuel stem 70 feeds one of the multiple of first main fuel nozzles 60A and thru the valve 72, one of the multiple of second main fuel nozzles 60B of each associated pair fueled by that fuel stem 70.

In one disclosed non-limiting embodiment (see FIG. 6), under a low power condition such as idle, the pilot fuel injection system 44 receives 100% of the fuel while the first and second multiple of main fuel nozzles 60A, 60B receive 0% of the fuel. Under a partial power condition, the pilot fuel injection system 44 receives about 20%-40% of the fuel, the multiple of first main fuel nozzles 60A receive the balance of about 80%-60% of the fuel and the multiple of second main fuel nozzles 60B receive 0% of the fuel as the valve 72 is closed. That is, the fuel distribution is axially variable in each can combustor 40. Notably, the fuel circulates thru at least a portion of the multiple of second main fuel nozzles 60B when the valve 72 is closed prior to communication to the respective multiple of first main fuel nozzles 60A of each pair. Under a high power condition, the pilot fuel injection system 44 receives about 20% of the fuel, the multiple of first main fuel nozzles 60A receive about 30%-40% of the fuel and the multiple of second main fuel nozzles 60B also receive about 30%-40% of the fuel as the valve 72 is open.

The pilot fuel injection system 44 maintains stability at low power while the axially staged main fuel injection system 46 facilitates control of heat release axially to control longitudinal acoustic modes. The main fuel injection system 46 may also be circumferentially staged to control heat release and thereby control tangential acoustic modes and may also be premixed to control emissions. Advantageously, other fuel distributions may alternatively or additionally be provided for these as well as other operational conditions. For example, the fuel distribution between the first and multiple of second main fuel nozzles 60A, 60B may be readily circumferentially varied to control combustion dynamics. Such control of combustion dynamics may additionally be utilized to vary the acoustic field within the combustor 56.

The pilot fuel injection system 44 facilitates stability at all power levels, while the main fuel injection system 46 provides axially staged injection and circumferentially staged injection controllability. NOx formation is not only a function of temperature, but also of flame residence time and Oxygen concentration in the reaction zone. Increasing the flame strain tends to reduce the residence time in the flame, but may also increase the Oxygen concentration in the flame. These intermediate effects of strain rates tend to increase the production rate of NOx. At high strain rates, however, the reduction in flame temperature overcomes the influence of the Oxygen concentration, and NOx production rates are reduced.

The use of the terms "a" and "an" and "the" and similar references in the context of description (especially in the context of the following claims) are to be construed to cover both the singular and the plural, unless otherwise indicated herein or specifically contradicted by context. The modifier "about" used in connection with a quantity is inclusive of the stated value and has the meaning dictated by the context (e.g., it includes the degree of error associated with measurement of the particular quantity). All ranges disclosed herein are inclusive of the endpoints, and the endpoints are independently combinable with each other. It should be appreciated that relative positional terms such as "forward," "aft," "upper," "lower," "above," "below," and the like are with reference to the normal operational attitude of the vehicle and should not be considered otherwise limiting.

Although the different non-limiting embodiments have specific illustrated components, the embodiments of this invention are not limited to those particular combinations. It is possible to use some of the components or features from any of the non-limiting embodiments in combination with features or components from any of the other non-limiting embodiments.

It should be appreciated that like reference numerals identify corresponding or similar elements throughout the several drawings. It should also be appreciated that although a particular component arrangement is disclosed in the illustrated embodiment, other arrangements will benefit herefrom.

Although particular step sequences are shown, described, and claimed, it should be understood that steps may be performed in any order, separated or combined unless otherwise indicated and will still benefit from the present disclosure.

The foregoing description is exemplary rather than defined by the features within. Various non-limiting embodiments are disclosed herein; however, one of ordinary skill in the art would recognize that various modifications and variations in light of the above teachings will fall within the scope of the appended claims. It is therefore to be appreciated that within the scope of the appended claims, the disclosure may be practiced other than as specifically described. For that reason the appended claims should be studied to determine true scope and content.

What is claimed is:

1. A combustor section for a gas turbine engine, comprising:

a can combustor including a combustion chamber;

a pilot fuel injection system in axial communication with the combustion chamber; and a main fuel injection system in radial communication with the combustion chamber, the main fuel injection system comprising a main fuel flow path that delivers fuel to a plurality of fuel stems, where each of the plurality of fuel stems constantly delivers fuel to an associated first main fuel nozzle during operation of the gas turbine engine, and where each of the plurality of fuel stems delivers fuel to an associated second main fuel nozzle that includes a valve in fluid communication with the fuel stem to selectively communicate fuel to the associated second main fuel nozzle.

2. The combustor section as recited in claim 1, wherein for each of the fuel stems the associated first main fuel nozzle and the associated second main fuel nozzle are fueled in pairs.

3. The combustor section as recited in claim 1, wherein the pilot fuel injection system includes a multiple of forward fuel injectors, one of the forward fuel injectors within each of a multiple of can combustors.

4. A gas turbine engine comprising:

a compressor section;

a turbine section;

a combustor section between the compressor section and the turbine section, the combustor section including a multiple of can combustors each including a combustion chamber;

a pilot fuel injection system in axial communication with the combustion chamber of each of the can combustors; and a main fuel injection system in radial communication with the combustion chamber of each of the can combustors, the main fuel injection system comprising a main fuel flow path that delivers fuel to a plurality of fuel stems, where each of the plurality of fuel stems constantly delivers fuel to an associated first main fuel nozzle during operation of the gas turbine engine, and where each of the plurality of fuel stems delivers fuel to an associated second main fuel nozzle that includes a valve in fluid communication with the fuel stem to selectively communicate fuel to the associated second main fuel nozzle.

5. The gas turbine engine as recited in claim 4, wherein the multiple of can combustors communicate with a transition section in communication with the turbine section.

6. The gas turbine engine as recited in claim 4, wherein the pilot fuel injection system includes a multiple of forward fuel injectors, one of the forward fuel injectors within each of the multiple of can combustors.

7. The gas turbine engine as recited in claim 6, wherein for each of the fuel stems the associated first main fuel nozzle and the associated second main fuel nozzle fueled in pairs.

8. A method of communicating fuel to a combustor section of a gas turbine engine, the method comprising:

communicating pilot fuel axially into a combustion chamber;

communicating fuel radially inboard into the combustion chamber; and circumferentially varying the fuel communicating radially inboard into the combustion chamber via a main fuel flow path that delivers fuel to a plurality of fuel stems, where each of the plurality of fuel stems constantly delivers fuel to an associated first main fuel nozzle during operation of the gas turbine engine, and where each of the plurality of fuel stems delivers fuel to an associated second main fuel nozzle that includes a valve in fluid communication with the fuel stem to selectively communicate fuel to the associated second main fuel nozzle.

* * * * *